US005317776A

United States Patent [19]

DeMoura

[11] Patent Number: 5,317,776

[45] Date of Patent: Jun. 7, 1994

[54] SWIMMING POOL VACUUM APPARATUS

[76] Inventor: Robert J. DeMoura, 21 Holloway, Berkley, Mass. 02779

[21] Appl. No.: 35,280

[22] Filed: Mar. 22, 1993

[51] Int. Cl.[5] ..... E04H 3/20

[52] U.S. Cl. ..... 15/1.7; 15/350

[58] Field of Search ..... 15/1.7, 344, 350, 351

[56] References Cited

U.S. PATENT DOCUMENTS

| | | | |
|---|---|---|---|
| 3,075,227 | 1/1963 | Bowles | 15/1.7 |
| 3,132,364 | 5/1964 | Oxley | 15/1.7 |
| 3,310,173 | 3/1967 | Sosower | 15/1.7 |
| 3,755,843 | 9/1973 | Goertzen | 15/1.7 |
| 4,213,224 | 7/1980 | Miller | 15/344 |
| 4,962,559 | 10/1990 | Schuman | 15/1.7 |

*Primary Examiner*—Edward L. Roberts
*Attorney, Agent, or Firm*—S. Michael Bender

[57] ABSTRACT

A new and improved swimming pool vacuum apparatus includes an extensible handle assembly which serves as a handle grasped by an operator and which supports a vacuum motor assembly. The vacuum motor assembly is used for providing vacuum power to a vacuum head assembly which contacts the bottom and the walls of a swimming pool. The vacuum head assembly is also supported by the extensible handle assembly. An electrical conductor assembly, connected between the vacuum motor assembly and a source of AC power, is used for conducting electrical power from the source of AC power to the vacuum motor assembly. The electrical conductor assembly includes a ground fault circuit interrupter assembly for interrupting electrical power flow from the source of AC power to the vacuum motor assembly in the event of a short circuit. The extensible handle assembly may include a plurality of handle units connected together in telescopic fashion and also includes an electrically insulating hand grip member.

6 Claims, 4 Drawing Sheets

SWIMMING POOL VACUUM APPARATUS

BACKGROUND OF THE INVENTION

1. Field of the Invention

The present invention relates generally to vacuum cleaners, and more particularly, to a vacuum apparatus especially adapted to clean swimming pools containing water.

2. Description of the Prior Art

Swimming pools accumulate debris over a period of time. Some of the debris is cleaned from the pool water as the water is recycled and filtered. Other debris sinks to the bottom of the pool and is not cleaned during water recycling and filtration. To clean the debris that sinks to the bottom of the pool, a swimming pool vacuum cleaner may be employed.

One form of swimming pool vacuum cleaner makes use of the swimming pool filter assembly. That is, normal connections of the swimming pool filter assembly are altered, and a long vacuum hose is attached to the filter. The vacuum hose is then used for vacuuming the pool. Moreover, the vacuum produced by the filter assembly may be insufficient unless the filter is backwashed. This requires additional time and effort. After the pool is vacuumed, the vacuum hose is disconnected, and the filter is returned to normal. These alterations to the filter system are time consuming and inconvenient. Moreover, the repetitive disassembly and reassembly of filter connections imposes unwanted wear and tear on the filter components. In this respect, it would be desirable to vacuum the pool without using the pool filter apparatus.

A number of swimming pool vacuum cleaners are disclosed in the prior art. For example, the following U.S. patents disclose swimming pool vacuum cleaner apparatus: U.S. Pat. Nos. 3,868,739 of Hargrave; 4,240,173 of Sherrill; 4,637,086 of Goode; 4,718,129 of Miller; and 4,962,559 of Shuman.

The patents to Sherrill, Goode, and Miller disclose devices which employ a vacuum source outside the pool and provide a vacuum hose running from the vacuum source to the bottom of the pool. The devices disclosed in these patents avoid any potential problems that might result if water and electricity were to mix. Yet, a disadvantage of these devices is that a large and heavy vacuum hose must be employed. Use of such a large and heavy vacuum hose is undesirable for a number of reasons. Much physical effort must be expended to unwind the hose, use the hose, and rewind the hose. The hose is susceptible to rotting and leaking, thereby reducing its effectiveness. A large hose requires quite a bit of storage space when the hose is not being used. It would be desirable, therefore, if a swimming pool vacuum apparatus were provided which avoided the use of a vacuum hose running from a vacuum source outside the pool to the bottom of the pool.

The patents to Hargrave and Shuman disclose swimming pool vacuum cleaners that avoid the use of long vacuum hoses by using submersible vacuum pumps. The vacuum pump in the Shuman patent is a cordless electric pump. A disadvantage of the Shuman device is that its effective use time is limited by the charge retained in its rechargeable batteries. In this respect, it would be desirable if an immersible swimming pool vacuum apparatus were provided which is not limited by a charge retained by rechargeable batteries.

The patent to Hargrave discloses a swimming pool vacuum cleaner which employs an electrical cord running from an immersible vacuum unit to a source of electricity, e.g. an AC outlet, outside the pool. It is well known that electricity and water do not mix. In this respect it does not appear that special provisions have been made with the Hargrave device to prevent electricity from being conducted from the underwater portions of the device to a person, outside the pool, using the device.

More specifically with respect to the Hargrave device, and generally with respect to immersible vacuum cleaners, it would be desirable if electrical protection were provided to protect a person outside the pool, who is using the underwater portion of the device, from electric shock or electrocution in the event that a short circuit develops in the underwater portion of the device.

The protection from electrical shock could take a number of forms. The protection could be an electrical protection device in the electric circuit powering the immersible vacuum cleaner. In addition, the protective device could take the form of means for electrically isolating the person outside the pool from the electrical portions of the device that are immersed in the pool water.

Aside from pool vacuuming, another chore associated with a swimming pool is the addition of appropriate chemicals to the pool. Generally, pool vacuuming is deemed to be one maintenance operation, and adding chemicals is deemed to be another maintenance operation. In this respect, it would be desirable if the pool vacuuming operation and the chemical addition operation could be combined into a single operation.

Another problems associated with swimming pool vacuum cleaners relates to the handle that is held by the operator outside the pool for controlling the vacuum unit located at the bottom of the pool. Such a handle must have a long effective length. Yet a long handle is very inconvenient when the unit must be stored when not in use. In this respect, it would be desirable to provide a handle for a swimming pool vacuum cleaner that is small and compact during storage, but that is sufficiently long when the handle is in use.

Thus, while the foregoing body of prior art indicates it to be well known to use immersible swimming pool vacuum cleaners, the prior art described above does not teach or suggest an immersible swimming pool vacuum apparatus which is not limited by a charge retained by rechargeable batteries and which provides electrical protection to protect a person outside the pool, who is using the underwater portion of the device, from electric shock or electrocution in the event that a short circuit develops in the underwater portion of the device. The prior art does not provide an electrical protection device in the electric circuit powering the immersible vacuum cleaner. Neither does the prior art provide means for electrically isolating the person outside the pool from the electrical portions of the device that are immersed in the pool water. Also, the prior art does not provide combining the pool vacuuming operation and the chemical addition operation into a single operation. In addition, the prior art does not provide a handle for a swimming pool vacuum cleaner that is small and compact during storage, but that is sufficiently long when the handle is in use. The foregoing disadvantages are overcome by the unique swimming pool vacuum apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved swimming pool vacuum apparatus which includes an extensible handle assembly which serves as a handle grasped by an operator and which supports a vacuum motor assembly. The vacuum motor assembly is used for providing vacuum power to a vacuum head assembly which contacts the bottom and the walls of a swimming pool. The vacuum head assembly is also supported by the extensible handle assembly. An electrical conductor assembly, connected between the vacuum motor assembly and a source of AC power, is used for conducting electrical power from the source of AC power to the vacuum motor assembly. The electrical conductor assembly includes a ground fault circuit interrupter assembly for interrupting electrical power flow from the source of AC power to the vacuum motor assembly in the event of a short circuit. The extensible handle assembly may include a plurality of handle units connected together in telescopic fashion and also includes an electrically insulating hand grip member.

The vacuum motor assembly includes a cylindrical housing assembly connected to the extensible handle assembly. The cylindrical housing assembly includes a cylindrical body member, a removable and replaceable input wall member, a removable and replaceable output wall member, and an open partition for defining a first chamber and a second chamber and for permitting communication between the first chamber and the second chamber. A vacuum generating assembly is housed in the first chamber and is used for generating vacuum. A filter cartridge assembly is housed in the second chamber and is used for filtering water that is vacuumed. The input wall member includes a first conduit for connecting the vacuum motor assembly to the vacuum head assembly. The input wall member and the output wall member include threads which engage complementary threads on the cylindrical body member. The output wall member includes an exhaust pipe.

A second conduit is connected to the exhaust pipe and is used for conveying flowing water pumped by the vacuum generating assembly. A venturi pipe assembly is connected to the second conduit and is used for creating a suction as water flows through the second conduit. A retention chamber, connected to the venturi pipe assembly, is used for retaining chemicals that are sucked into the venturi pipe assembly as water flows through the second conduit.

The venturi pipe assembly includes a plurality of branch tubes spaced along a manifold assembly connected to a main venturi tube. The retention chamber include a plurality of retention cells arranged in an array, such that each of the retention cells receives one of the branch tubes. The manifold assembly includes a plurality of valve assemblies which enable selective dispensing of chemicals from selected retention cells.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved swimming pool vacuum apparatus which has all of the advantages of the prior art and none of the disadvantages.

It is another object of the present invention to provide a new and improved swimming pool vacuum apparatus which may be easily and efficiently manufactured and marketed.

It is a further object of the present invention to provide a new and improved swimming pool vacuum apparatus which is of durable and reliable construction.

An even further object of the present invention is to provide a new and improved swimming pool vacuum apparatus which is susceptible of a low cost of manufacture with regard to both materials and labor, and which accordingly is then susceptible of low prices of sale to the consuming public, thereby making such swimming pool vacuum apparatus available to the buying public.

Still yet a further object of the present invention is to provide a new and improved swimming pool vacuum apparatus which vacuums the pool without using the pool filter apparatus.

Still another object of the present invention is to provide a new and improved swimming pool vacuum apparatus which avoids the use of a vacuum hose running from a vacuum source outside the pool to a vacuuming unit located on the bottom of the pool.

Yet another object of the present invention is to provide a new and improved swimming pool vacuum apparatus that includes an immersible swimming pool vacuum unit which is not limited by a charge retained by rechargeable batteries.

Even another object of the present invention is to provide a new and improved swimming pool vacuum apparatus the protects a person outside the pool, who is using the underwater portion of the device, from electric shock or electrocution in the event that a short circuit develops in the underwater portion of the device.

Still a further object of the present invention is to provide a new and improved swimming pool vacuum apparatus that employs an electrical protection device in the electric circuit powering the immersible vacuum cleaner.

Yet another object of the present invention is to provide a new and improved swimming pool vacuum apparatus that includes means for electrically isolating the person outside the pool from the electrical portions of the device that are immersed in the pool water.

Still another object of the present invention is to provide a new and improved swimming pool vacuum apparatus that combines the pool vacuuming operation and the chemical addition operation into a single operation.

Yet another object of the present invention is to provide a new and improved swimming pool vacuum apparatus that has a handle that is small and compact during storage, but that is sufficiently long when the handle is in use.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
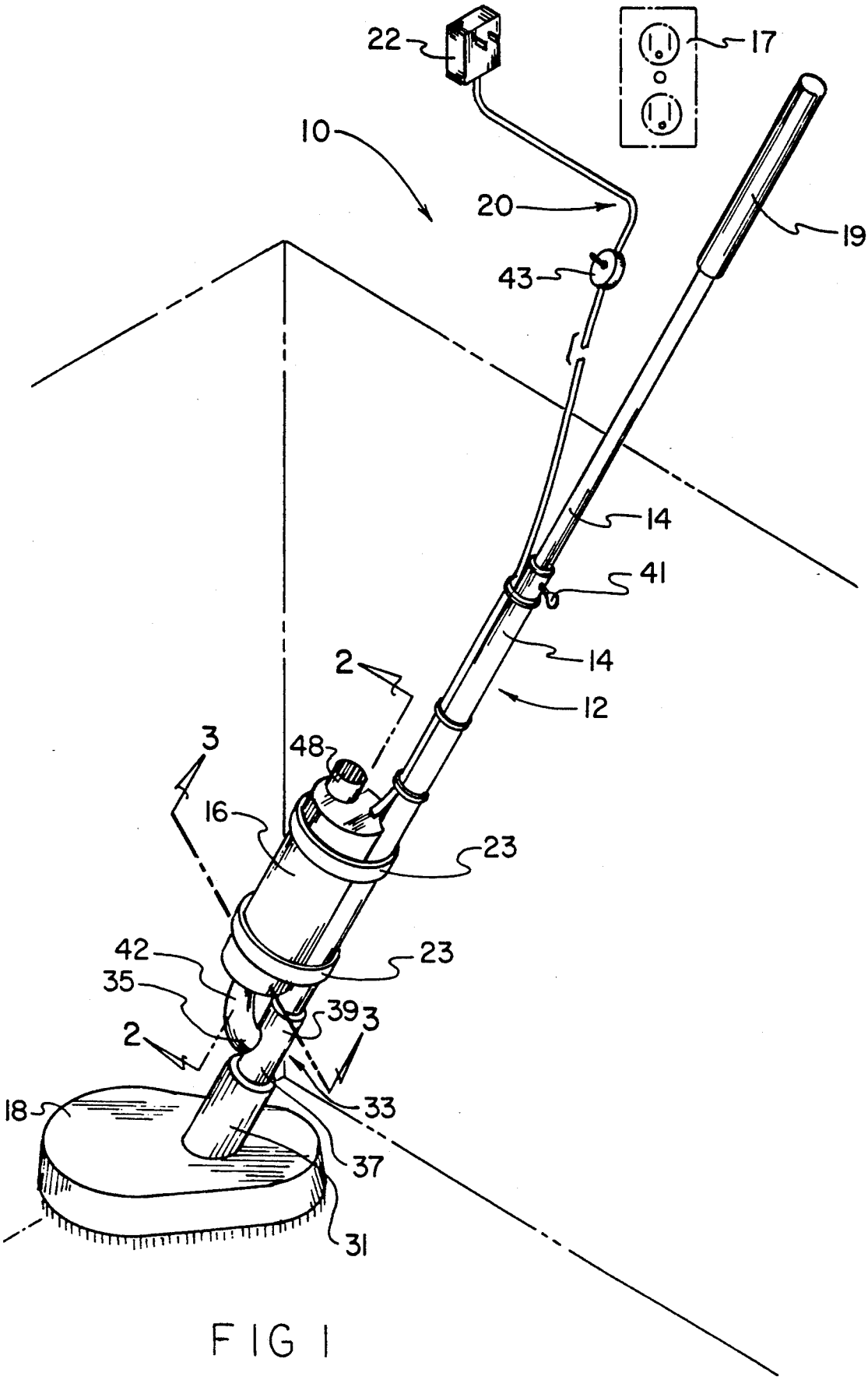
FIG. 1 is a perspective view showing a first preferred embodiment of the swimming pool vacuum apparatus of the invention.
Figure 2:
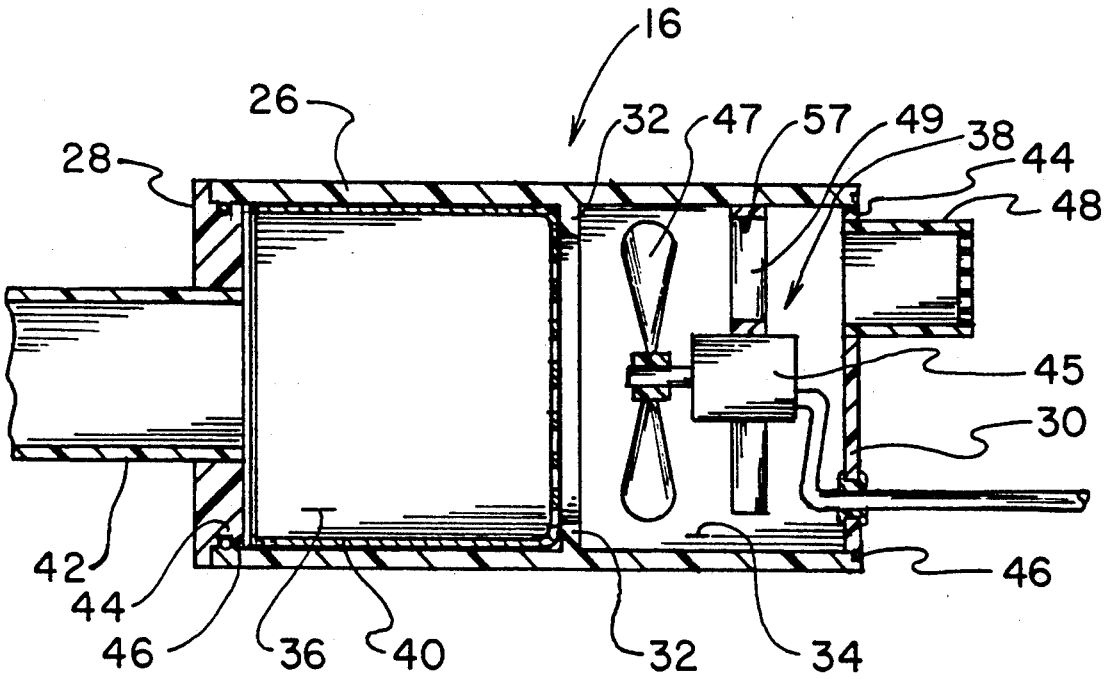
FIG. 2 is a cross-sectional view of the vacuum motor assembly of the swimming pool vacuum apparatus of the invention shown in FIG. 1 taken along line 2—2 of FIG. 1.
Figure 3:
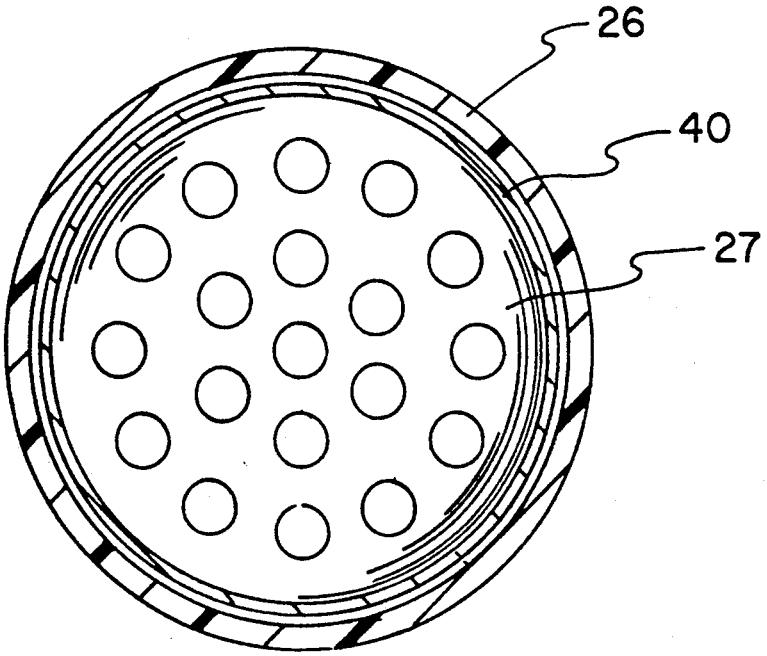
FIG. 3 is a cross-sectional view of the vacuum motor assembly of the swimming pool vacuum apparatus of the invention shown in FIG. 1 taken along line 3—3 thereof.
Figure 4:
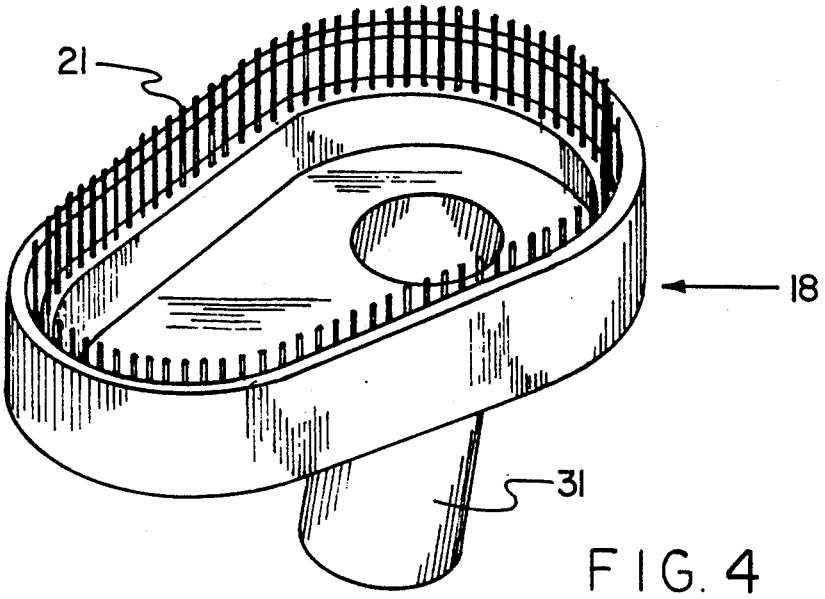
FIG. 4 is an enlarged, bottom perspective view of the vacuum head assembly of the embodiment of the invention shown in FIG. 1.

With reference to the drawings, a new and improved swimming pool vacuum apparatus embodying the principles and concepts of the present invention will be described.

Turning initially to FIGS. 1–4, there is shown a first exemplary embodiment of the swimming pool vacuum apparatus of the invention generally designated by reference numeral 10. In its preferred form, swimming pool vacuum apparatus 10 includes an extensible handle assembly 12 which includes a plurality of handle units 14, for serving as a handle grasped by an operator and for supporting a vacuum motor assembly 16. The vacuum motor assembly 16 is supported by the extensible handle assembly 12 provides vacuum power to a vacuum head assembly 18. The vacuum head assembly 18 is connected to the vacuum motor assembly 16 and is used for contacting a bottom 13 and walls 15 of a swimming pool. The vacuum head assembly 18 is also supported by the extensible handle assembly 12. The vacuum head assembly 18 includes bristles 21 and an adaptor portion 31 which is connected to a T-shaped member 33 which has one branch 35 connected to the first conduit 42, one branch 37 connected to the adaptor portion 31, and one branch 39 connected to the handle assembly 12. Inside the T-shaped member 33, water flows under vacuum from branch 37 to branch 35. Branch 39 forms a vacuum tight seal with an end of the extensible handle assembly 12 through which water does not flow.

An electrical conductor assembly 20, connected between the vacuum motor assembly 16 and a source of AC power 17 is used for conducting electrical power from the source of AC power 17 to the vacuum motor assembly 16. The electrical conductor assembly 20 includes a ground fault circuit interrupter assembly 22 for interrupting electrical power flow from the source of AC power 17 to the vacuum motor assembly 16 in the event of a short circuit. In this respect, a user of the apparatus 10 is prevented from being subjected to electric shock or electrocution in the event that a short circuit develops in the underwater portion of the device. An on/off switch 43 is also provided.

The handle unit 14 that is grasped by the operator (not shown) includes an electrically insulating hand grip member 19 which electrically isolates the operator outside the pool from the electrical portions of the device that are immersed in the pool water. The extensible handle assembly 12 includes a plurality of handle units 14 connected together in telescopic fashion. A lock nut 41 is used to fix one telescoping handle unit 14 with respect to another handle unit 14 when an appropriate effective length for the handle is selected. When the swimming pool vacuum apparatus 10 of the invention is not in use, the telescopic handle members 14 are nested together to form a compact and easily stored unit.

The vacuum motor assembly 16 includes a cylindrical housing assembly which is connected to the extensible handle assembly 12 by a plurality of removable straps 23. The cylindrical housing assembly includes a cylindrical body member 26 and a removable and replaceable input wall member 28, connected to the cylindrical body member 26, which includes a first conduit 42 for connecting the vacuum motor assembly 16 to the vacuum head assembly 18. The cylindrical housing assembly also includes a removable and replaceable output wall member 30 connected to the cylindrical body member 26 and an open partition 32, connected to the cylindrical body member 26, for defining a first chamber 34 and a second chamber 36 and for permitting communication between the first chamber 34 and the second chamber 36. A vacuum generating assembly 38 is housed in the first chamber 34 and is used for generating vacuum. The vacuum generating assembly 38 includes an AC powered motor 45 and an impeller 47 driven by the motor 45. The motor 45 is supported by a bracket 49 that has an open area 57 for permitting water to flow therethrough.

A filter cartridge assembly 40 is housed in the second chamber 36 and is used for filtering water that is vacuumed. A perforated wall 27 is present on each side of the filter cartridge assembly 40 for permitting water to flow in one side and out the other side of the assembly 40.

The removable and replaceable input wall member 28 and the removable and replaceable output wall member 30 include threads 44 which engage complementary threads 46 on the cylindrical body member 26. When the input wall member 38 is removed, the filter cartridge assembly 40 can be replaced. When the output wall member 30 is removed, the motor 45 and impeller 47 can be serviced. The removable and replaceable output wall member 30 includes an exhaust pipe 48.

Figure 5:
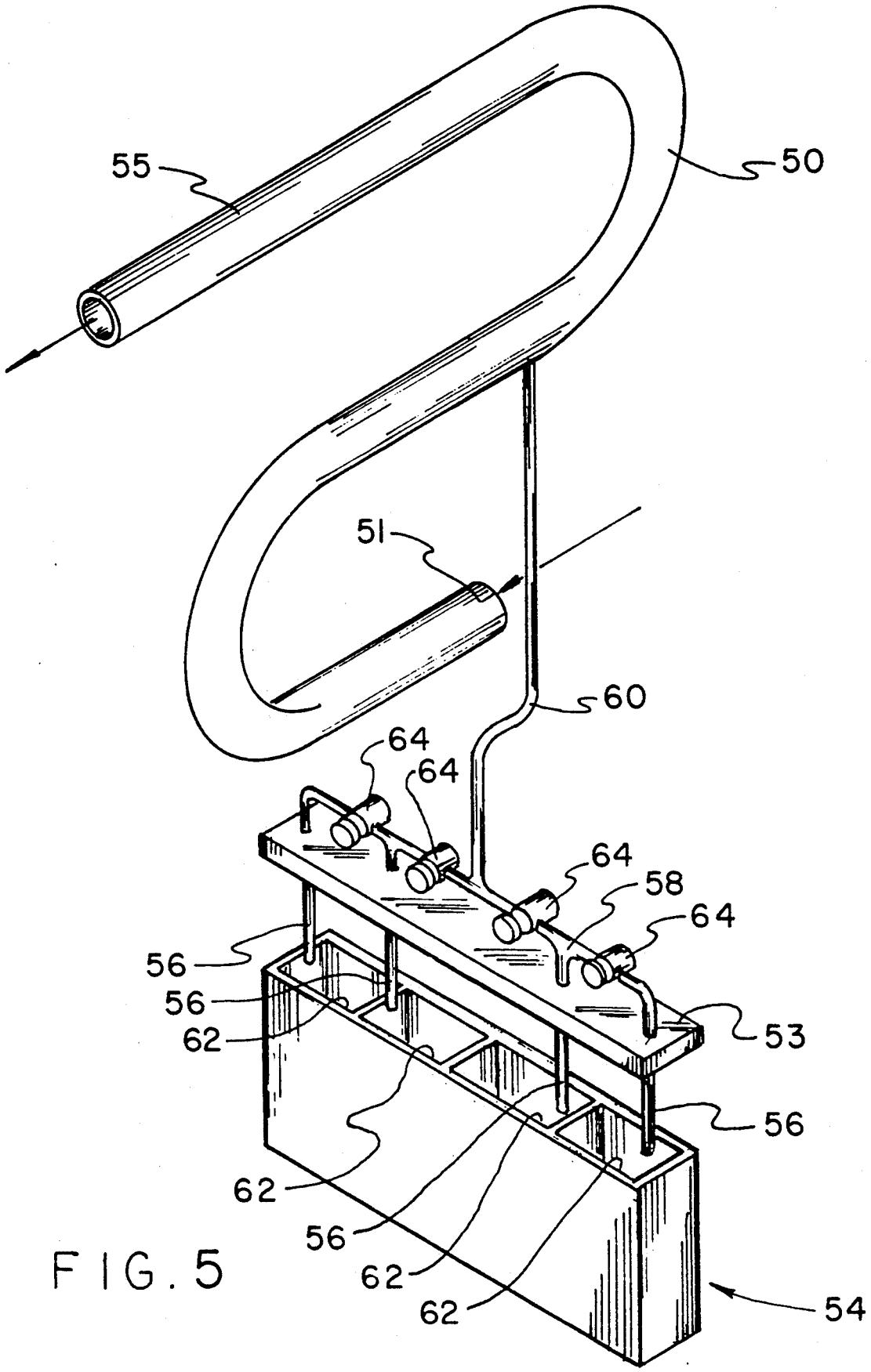
FIG. 5 is a perspective view of a venturi pipe assembly and retention chamber used to provide a second preferred embodiment of the swimming pool vacuum apparatus of the invention.

Turning to FIG. 5, a venturi pipe assembly and retention chamber are shown that are used to provide a second preferred embodiment of the swimming pool vacuum apparatus of the invention. Reference numerals are shown that correspond to like reference numerals that designate like elements shown in the other figures. In addition, a second conduit 50, at first end 51, is connected to the exhaust pipe 48 of the output wall member 30. The second conduit 50 is used for conveying flowing water pumped by the vacuum generating assembly 38. A venturi pipe assembly is connected to the second conduit 50 and is used for creating a negative pressure or suction as water flows through the second conduit 50. The venturi pipe assembly includes a plurality of branch tubes 56 spaced along a manifold assembly 58 connected to a main venturi tube 60.

A retention chamber 54 is connected to the venturi pipe assembly by means of lid 53 which receives branch tubes 56 of the venturi pipe assembly. The retention chamber 54 is used for retaining chemicals that are sucked into the venturi pipe assembly as water flows through the second conduit 50. More specifically, the retention chamber 54 includes a plurality of retention cells 62 arranged in an array, such that each of the retention cells 62 receives one of the branch tubes 56 attached to the lid 53.

The manifold assembly 58 includes a plurality of valve assemblies 64 which enable selective dispensing of chemicals from selected retention cells 62. The dispensed chemicals, along with the water that has been vacuumed, exit from the second end 55 of the second conduit 50 into the bulk of the water in the swimming pool. In use, preferably, the elements of the invention shown in FIG. 5 can be carried by the handle assembly 12. In this respect, with the invention, the pool vacuuming operation and the chemical addition operation can be combined into a single operation. Alternatively, the elements of the invention shown in FIG. 5 can be placed outside of the pool at pool side.

It is understood that when the swimming pool vacuum apparatus 10 of the invention is immersed in water, the buoyant effects of water have the effect of reducing the perceived weight of the apparatus. This makes movement of the apparatus under water easier than it would be if the apparatus were used outside the water.

Figure 6:
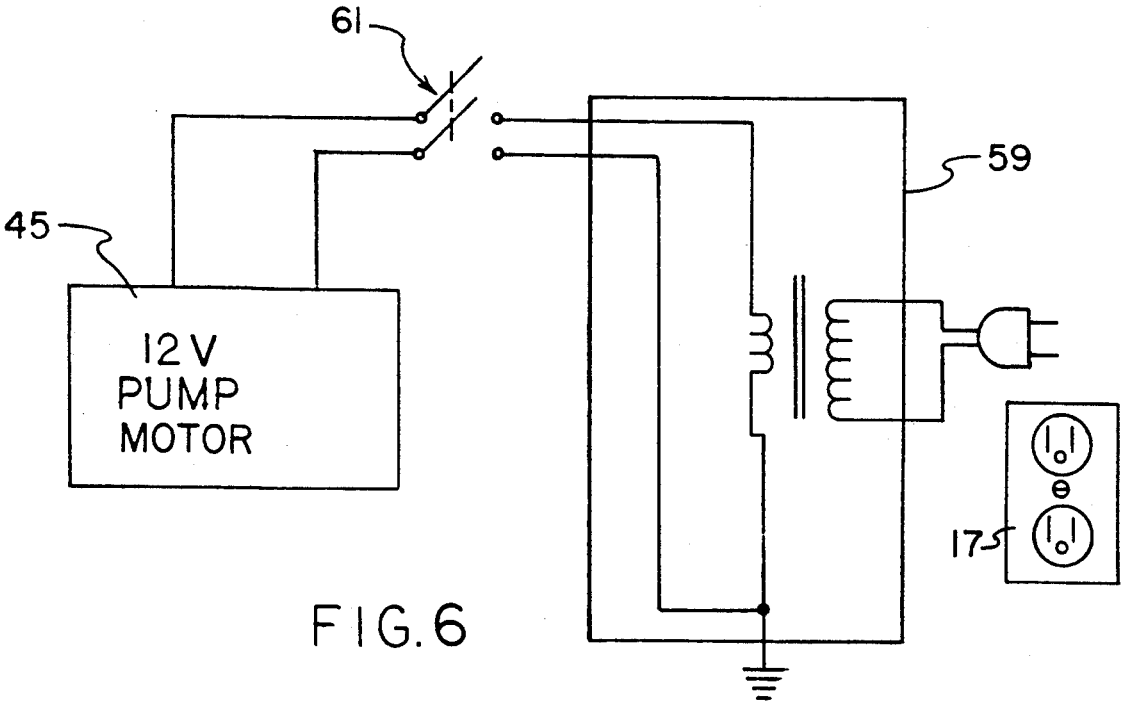
FIG. 6 is a schematic electrical circuit diagram for a vacuum generating assembly that includes a motor that is driven by a voltage less than 110 VAC.

Turning to FIG. 6, a schematic electrical circuit diagram is shown for a vacuum pump motor 45. The motor operates on 12 VAC, so a transformer 59 is used to step down the source voltage from 110 VAC to 12 VAC. An on/off switch 61 is used to complete the circuit to the motor 45.

All of the major components of the swimming pool vacuum apparatus of the invention can be fabricated from inexpensive metal or plastic materials. In this respect, embodiments of the swimming pool vacuum apparatus of the invention can be made inexpensively.

It is apparent from the above that the present invention accomplishes all of the objects set forth by providing a new and improved swimming pool vacuum apparatus that is low in cost, relatively simple in design and operation, and which may advantageously be used to vacuum the pool without using the pool filter apparatus. Moreover, with the invention, the use of a vacuum hose running from a vacuum source outside the pool to the bottom of the pool is avoided. The swimming pool vacuum apparatus of the invention is not limited by a charge retained by rechargeable batteries. With the invention, electrical protection is provided to protect a person outside the pool, who is using the underwater portion of the device, from electric shock or electrocution in the event that a short circuit develops in the underwater portion of the device. Also, with the invention, an electrical protection device is provided in the electric circuit that provides electric power to the immersible vacuum cleaner. In addition, means are provided for electrically isolating the person outside the pool from the electrical portions of the device that are immersed in the pool water. Also, with the invention, the pool vacuuming operation and the chemical addition operation can be combined into a single operation. In addition, with the invention, a swimming pool vacuum apparatus is provided that includes a handle that is small and compact during storage, but that is sufficiently long when the handle is in use.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications.

What is claimed as being new and desired to be protected by letters patent of the United States is as follows:

1. A swimming pool vacuum apparatus, comprising:

extensible handle assembly means which includes a plurality of handle units, for serving as a handle grasped by an operator and for supporting vacuum motor assembly means, respectively, vacuum motor assembly means, supported by said extensible handle assembly means, for providing vacuum power to vacuum head assembly means, vacuum head assembly means, connected to said vacuum motor assembly means, for contacting a bottom and walls of a swimming pool, wherein said vacuum head assembly means are supported by said extensible handle assembly means, and electrical conductor assembly means, connected between said vacuum motor assembly means and a source of electrical power, for conducting electrical power from said source to said vacuum motor assembly means, wherein said vacuum motor assembly means includes:

a cylindrical housing assembly connected to said extensible handle assembly means, wherein said cylindrical housing assembly includes a cylindrical body member, a removable and replaceable input wall member connected to said cylindrical body member which includes first conduit means for connecting said vacuum motor assembly means to said vacuum head assembly means, a removable and replaceable output wall member connected to said cylindrical body member, and open partition means, connected to said cylindrical body member, for defining a first chamber and a second chamber and for permitting communication between said first chamber and said second chamber, vacuum generating assembly means, housed in said first chamber, for generating vacuum, and filter cartridge assembly means, housed in said second chamber, for filtering water that is vacuumed.

2. The apparatus described in claim 1 wherein said handle unit that is grasped by the operator includes an electrically insulating hand grip member.

3. The apparatus described in claim 1 wherein said extensible handle assembly means include a plurality of handle units connected together in telescopic fashion.

4. The apparatus described in claim 1 wherein said removable and replaceable input wall member and said removable and replaceable output wall member include threads which engage complementary threads on said cylindrical body member.

5. The apparatus described in claim 1 wherein said removable and replaceable output wall member includes an exhaust pipe.

6. The swimming pool vacuum apparatus of claim 1 wherein said source of power comprises a source of AC electrical power and wherein said electrical conductor assembly means include ground fault circuit interrupter means for interrupting electrical power flow from said source of AC power to said vacuum motor assembly means in the event of a short circuit.

* * * * *